US005264902A

United States Patent [19]

Suwa et al.

[11] Patent Number: 5,264,902

[45] Date of Patent: Nov. 23, 1993

[54] IMAGE FORMING DEVICE

[75] Inventors: Koichi Suwa; Masahiro Goto; Takahiro Inoue; Koichi Hiroshima, all of Yokohama; Shinichi Tsukida, Okegawa; Junichi Kato, Sagamihara; Hideyuki Yano, Yokohama; Manabu Takano, Machida, all of Japan

[73] Assignee: Canon Kabushiki Kaisha, Tokyo, Japan

[21] Appl. No.: 4,676

[22] Filed: Jan. 14, 1993

Related U.S. Application Data

[63] Continuation of Ser. No. 651,014, Feb. 4, 1991, abandoned.

[30] Foreign Application Priority Data

Feb. 7, 1990 [JP] Japan ..... 2-29298
Jun. 29, 1992 [JP] Japan ..... 2-169823

[51] Int. Cl.[5] ..... G03G 15/20

[52] U.S. Cl. ..... 355/282; 355/271; 355/277; 355/285

[58] Field of Search ..... 29/130, 132; 219/216, 219/388, 469; 355/271, 273, 276, 277, 282, 284, 285, 289, 290

[56] References Cited

U.S. PATENT DOCUMENTS

| | | | |
|---|---|---|---|
| 3,781,105 | 12/1973 | Meagher | 355/274 |
| 3,912,901 | 10/1975 | Strella et al. | 219/216 |
| 4,161,644 | 7/1979 | Yanagawa et al. | 219/216 |
| 4,533,231 | 8/1985 | Shigenobu | 355/284 |
| 4,568,275 | 2/1986 | Sakurai | 432/60 |
| 4,652,110 | 3/1987 | Sato et al. | 355/315 |
| 4,674,860 | 6/1987 | Tokunaga et al. | 355/4 |
| 4,823,689 | 4/1989 | Kishino et al. | 100/155 R |
| 4,829,931 | 5/1989 | Mogi | 118/60 |
| 4,842,944 | 6/1989 | Kuge et al. | 428/451 |
| 4,967,231 | 10/1990 | Hosoya et al. | 355/219 |
| 4,970,559 | 11/1990 | Miyabayashi | 355/290 |

FOREIGN PATENT DOCUMENTS

| | | |
|---|---|---|
| 59-04664 | 3/1984 | Japan . |
| 61-151676 | 7/1986 | Japan . |
| 61-176954 | 8/1986 | Japan . |
| 61-212873 | 9/1986 | Japan . |

*Primary Examiner*—Leo P. Picard
*Assistant Examiner*—Christopher Horgan
*Attorney, Agent, or Firm*—Fitzpatrick, Cella, Harper & Scinto

[57] ABSTRACT

The image forming device of the present invention relates to an image forming device having a moving member which moves while pressing a recording material against an image carrying member as the means of transferring the image on the image carrying member to the recording material. Further, the image forming device has a pair of moving members for fixing the image by conveying the recording material sandwiched therebetween, of which the moving member on the side not in contact with the unfixed image is a moving member having an elastic material layer and a resin surface layer. Further, the present invention has the surface of the moving member of the fixing member on the side not in contact with the unfixed image which is better mold releasability with that of the moving member of the image forming device.

39 Claims, 4 Drawing Sheets

IMAGE FORMING DEVICE

This application is a continuation of application Ser. No. 07/651,014, filed Feb. 4, 1991, now abandoned.

BACKGROUND OF THE INVENTION

1. Field of the Invention

This invention relates to an image forming device such as electrophotographic device or electrostatic recording device, etc., typically a copying machine, laser beam printer, etc., and particularly to an image forming device equipped with a transfer means having a moving member which moves while pressing a recording material against an image carrying or bearing member as the means for transferring the image on the image carrying member onto the recording material, namely the so called contact type transfer means.

2. Related Background Art

The image forming device of the prior art by use of the transfer means of the contact type is described by referring to a laser beam printer as shown in FIG. 1.

The unfixed toner image formed on the photosensitive drum by the primary charger 8, the laser beam scanner 1, and the developing device 3 each arranged respectively around the photosensitive drum 2 as the image carrying member, is transferred by the transfer roller 4 pressure contacted with the photosensitive drum 2 onto the recording material 5. The residual toner after transfer is recovered from the photosensitive drum 2 by the cleaning device 7. On the other hand, the toner image transferred onto the recording material is fixed by the fixing device 14.

FIG. 2 is an enlarged sectional view of the fixing device 14.

The fixing device 14 has a pair of rollers 15, 16 arranged in pressure contact with each other, and fixing is carried out by heating the rollers by means of a heating means. The fixing roller 15 is constructed of a fluorine resin layer provided on the outer surface of a hollow aluminum core metal, and a halogen heater 11 is arranged therein. The member 17 functions as both a silicone oil coating device and a cleaning device, and comprises the cleaning member 17A made of a heat-resistant felt impregnated with a silicone oil. A holder 17B is supporting cleaning member 17A, which is pressed against the fixing roller 15. The pressurizing roller 16 has the elastic layer 16A made, for example, of the low temperature vulcanization type silicone rubber (LTV) around the core metal 16B.

The contact transfer device as represented by the transfer roller 4, which can perform transfer at lower voltage as compared with corona transfer device and therefore can transfer and convey a diversity of recording materials from thin paper to envelope, having further the advantage of little generation of ozone, and further excellent in conveying force of the recording material. As still another advantage, there is little poor or fault image generated during transfer. For this reason, it is effective for a compact electrophotographic printer, etc.

However, in the image forming device having the transfer roller 4 and the heating roller fixing device 14 of the prior art as described above, the following problems have been found.

(1) The toner on the image carrying member, the paper powder generated from the recording material, etc. are conveyed from the transfer roller 4 onto the back surface of the recording material and then onto the pressurizing roller 16, whereby mold releasability of the pressurizing roller is lowered. For this reason, the pressurizing roller 16 in the heating roller fixing device 14 is contaminated, and as the progress of contamination, such phenomena as luster irregularity of the fixed image, back contamination of the recording material, winding of the recording material around the pressurizing roller, etc. are generated.

Accordingly, the life of the pressurizing roller becomes shorter, and as compared with durability of about 100,000 sheets when using a corona transfer device, durability life is shortened to about 30,000 sheets on account of pressurizing roller contamination.

(2) The transfer roller 4 forms a roller pair with the photosensitive drum 2 which is an image carrying member and conveys the recording material. At this time, since their circumferential speed is not exactly the same as that of the roller pair within the fixing device, a stress is applied on the recording material between the transfer roller 4 and the fixing device 14. Due to the influence of the stress, wrinkle of the recording material is liable to be generated when passing through the fixing device. The phenomenon is more likely to occur with thin paper or envelope.

Whereas, concerning the above phenomenon (1), it can be solved by making cleaning of the transfer roller 4 complete, but provision of a cleaning member on the transfer roller 4 will make the device more complicated, and also poses a problem in disposal of the toner that has been cleaned off the transfer roller 4.

Further, for the transfer roller 4, an elastic material is employed for forming a nip between it and the photosensitive drum 2. At this time, if the nip is not formed under a low pressure, the so called void or hollow character phenomenon will be generated, which is the phenomenon in which the central portion of the character is not transferred. Therefore, a rubber of low hardness or a foamed sponge, etc. is used for the transfer roller 4. For this reason, the surface roughness of the transfer roller 4 is rough and also its coefficient of friction is high, thus also posing a problem that the toner can be cleaned from it only with difficulty.

On the other hand, concerning the phenomenon (2), wrinkles can be improved by making lower the pressing force of the transfer roller 4 against the photosensitive drum 2 and rotating said roller subject to the photosensitive roller. However, the shock from when the recording material enters into the fixing instrument or the shock when it has passed out of the feeding paper, the resist roller, poor or fault image is generated. Concerning this problem, it can be also solved by taking good distance between transfer and fixing to form a loop of the recording material, but it is difficult to take such space in a compact printer, etc.

Thus, in an image forming device by use of the contact type transfer device such as transfer roller as the transfer means, it has been difficult to effect fixing with excellent conveyability, durability.

SUMMARY OF THE INVENTION

The present invention has been accomplished in view of the problems as described above, and has an object to provide an image forming device which can obtain images without image irregularity and with good fixability.

Another object of the present invention is to provide an image forming device which can prevent such phenomena as contamination of the recording material, winding of the recording material, etc.

Still another object of the present invention is to provide an image forming device which can perform stably conveying of the recording material irrespective of the kind of the recording material without generation of wrinkle, etc. on the recording material.

Still another object of the present invention is to provide an image forming device which can improve the durability life of the fixing device and can correspond to speed-up of image formation.

Other objects than those mentioned above and the specific features of the present invention will become more apparent by reading the following detailed description by referring to the accompanying drawings.

DETAILED DESCRIPTION OF THE PREFERRED EMBODIMENTS

Figure 1:
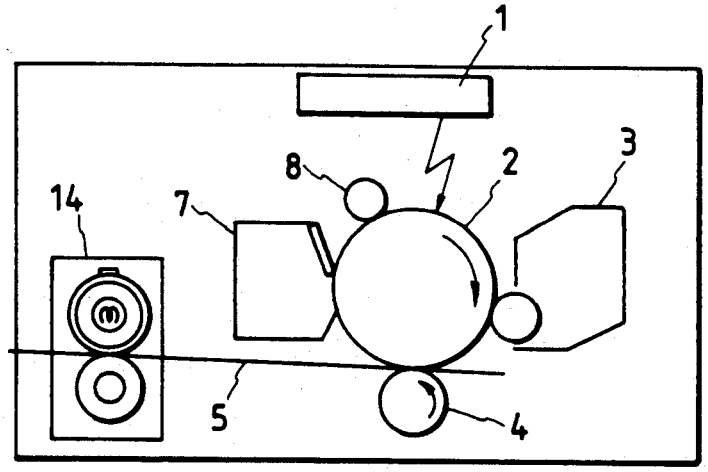
FIG. 1 is a schematic sectional view of the image forming device of the prior art.
Figure 2:
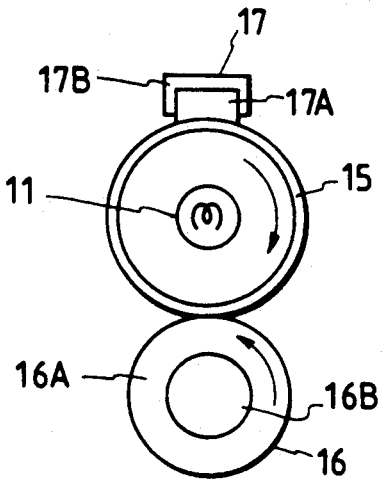
FIG. 2 is a schematic sectional view of the fixing device of the image forming device shown in FIG. 1.
Figure 3:
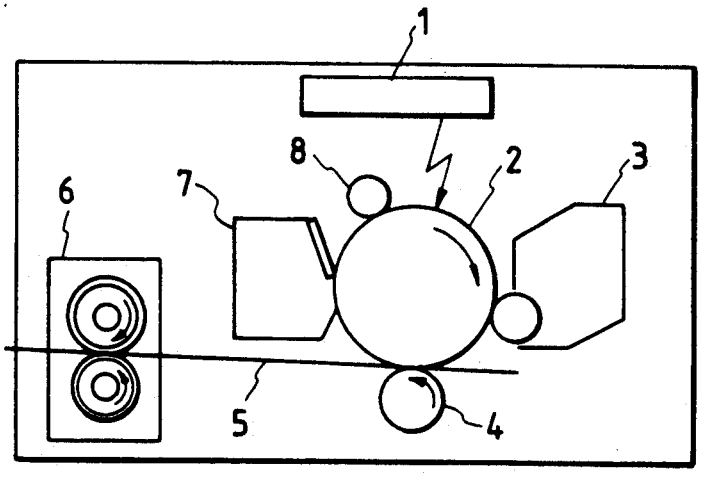
FIG. 3 is a schematic sectional view of the image forming device of an embodiment of the present invention.

FIG. 3 shows an image forming device of an embodiment of the present invention. Description of those common with the members shown in FIG. 1 is omitted with attachment of the same symbols.

First, in this embodiment, the rotatory member 4 (hereinafter called "transfer roller") for transfer as the moving member which moves while pressing a recording member against the image carrying member has an elastic material layer such as a rubber (e.g., EPDM, urethane, silicone, NBR, etc.) or a foamed sponge around its shaft core metal, and the resistance value of the elastic material layer is controlled by dispersing a filler such as carbon black, metallic powder, etc. or a metal oxide such as tin oxide, titanium oxide, zinc oxide, etc.

As to driving of the roller, for example, the method of transmitting driving to the transfer roller by providing a driving gear on a photosensitive drum 2 as the image carrying member is used. The transfer roller 4 has a hardness of 15 to 40 degrees (ASKERC), a resistance value of $10^6$ to $10^9\Omega$, with the circumferential speed being driven at a speed more rapid by 1 to 5% relative to the photosensitive drum 2, whereby a good transfer image without void or hollow character, defective transfer, etc. and also without poor or faulty image can be obtained.

In the present embodiment, particularly a transfer roller obtained by polishing the surface with an EPDM sponge with a hardness of 30 degrees (ASKERC) and a resistance value of $10^8\Omega$ to an outer diameter of 18 mm was used and it was driven at a circumferential speed more rapid by 3% than the photosensitive drum 2. Of the above-mentioned numerical values, hardness is that after molded into the roller, the resistance value is a value of the resistance between the core metal and the electrode determined by application of a voltage of 1 KV when an electrode with a width of 10 mm was wound around the peripheral surface of the transfer roller 4, and the circumferential speed determined from the angular speed and the outer diameter of the transfer roller 4. The distance between the nip formed between the transfer roller and the photosensitive drum and the roller pair for fixing as described below is shorter than the recording material length with the maximum size (with respect to the conveying direction of the recording material).

Figure 4:
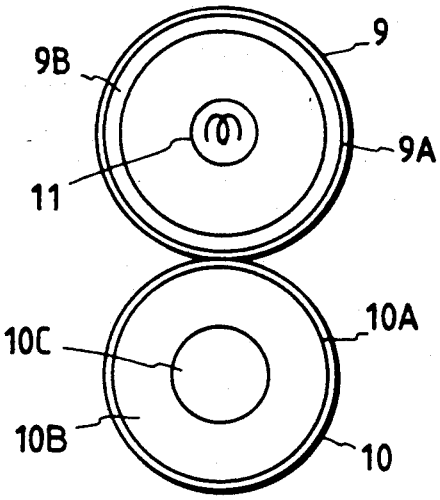
FIG. 4 is a schematic sectional view showing the fixing device of the embodiment in FIG. 3.

Next, an embodiment of the fixing device in the present invention is shown in FIG. 4.

The fixing device 6 in FIG. 3 has a pair of rotatory members as a pair of moving members for conveying a recording material sandwiched therebetween. The paired rotatory members are the fixing roller 9 and the pressurizing roller 10.

The fixing roller 9 has a hollow structure, having a fluorine resin layer 9A which was obtained by applying a primer around an aluminum core metal 9B with a reverse crown shape having an outer diameter at the central portion smaller than the edge portion, and then applying PFA dispersion coating, followed by sintering. Within the fixing roller core metal 9B is provided a halogen heater 11 for heating.

The fixing roller 9 has its surface temperature detected by a temperature detecting device (not shown), and current passage to the heater 11 is controlled so that the detection temperature may be constant.

For the pressurizing roller 10 not in contact with the unfixed side, an HTV or LTV silicone rubber layer 10B is provided around the shaft-like core metal 10C, and further a tube 10A of a tetrafluoroethyleneperfluoroalkyl vinyl ether copolymer (PFA) coated as the upper layer thereon. The pressure roller 10 at this time is made to have a crown shape with the diameter at the central portion being made larger as compared with the edge portion. The PFA tube has excellent non-tackiness as a matter of course as well as abrasion resistance, and therefore during usage over a long term, it can be a surface layer which can maintain non-tackiness.

The present inventors have conducted durability tests by use of a pressurizing roller with an outer diameter of 20 mm having a PFA tube coated on an LTV silicone rubber (JISA 15 degrees) with a thickness of 5 mm in the image recording device shown in FIG. 3, without providing neither a mold release agent coating mechanism nor a cleaning mechanism.

As the result, even after paper passage of 300,000 sheets, there was little contamination of the pressurizing roller 10 observed and yet such contamination is not under the state secured, but merely to the extent that it can be fallen off by rubbing lightly with a finger. Also, when a thin paper (basis weight 52 g/m$^2$) or an envelope was passed under high temperature and high humidity (32.5° C., 80%), no wrinkle was generated, and the image obtained was also good.

On the other hand, when a comparative experiment was conducted by use of a pressurizing roller with an outer diameter of 20 mm having only an LTV silicone rubber with a hardness of 25 degrees (JISA) coated to a thickness of 5 mm on the core metal, the pressurizing roller was contaminated after paper passage of 30,000 sheets, whereby winding of the paper around the pressurizing roller was generated. Also, wrinkles of thin paper and envelope having absorbed moisture were observed under high temperature and high humidity.

The reason for such difference may be considered as follows.

Concerning for pressurizing roller contamination, since the transfer roller 4 is constantly in contact with the photosensitive drum 2, fog or background toner, reversal fog toner on the photosensitive drum 2 is attached on the transfer roller 4. However, in the present embodiment, since the transfer roller 4 is applied with a bias of the same polarity as the toner (namely the bias of the opposite polarity to the bias during transfer) during pre-rotation and post-rotation before and after the transfer step, the toner attached on the transfer roller 4 is reversely transferred onto the photosensitive drum 2. Thus, contamination of the transfer roller 4 can be removed by making the bias voltage to have the opposite polarity without any practical problem without provision of any special cleaning means.

As the result, back contamination of the recording material can be prevented to the extent where contamination cannot be observed with eyes, but practically the toner on the transfer roller 4 cannot be cleaned to 100%, but slightly the toner is attached on the back surface of the recording material to be carried to the pressurizing roller 10. For this reason, when the pressure roller has tackiness, even little, contamination will be generated by the toner. Particularly, when the pressurizing roller surface has poorer mold releasability than the transfer roller surface, this phenomenon is conspicuous.

Since the transfer roller 4 is driven at a circumferential speed more rapid than that of the photosensitive drum 2, a relative speed difference will necessarily occur between the roller and the recording material. As the result, not only is the amount of paper powder generated on the recording material increased, but also attachment of toner, paper powder onto the back surface of the recording material is promoted.

On the other hand, as for paper wrinkle, since the paper delivery speed is different between the transfer roller and the pair of fixing rollers, a stress is applied on the paper to generate wrinkles. For releasing the stress, it is desirable the paper be slipped, even to a slight extent, between the transfer roller and the photosensitive drum or between the pressurizing roller and the fixing roller. Here, the slip between the transfer roller and the photosensitive drum will appear as a poor or faulty image, and therefore it is preferable to effect a slippage between the fixing roller and the pressurizing roller. Therefore, lubricity is demanded for the fixing roller and the pressurizing roller, and particularly the surface lubricity of the pressurizing roller is important.

Thus, in an image forming device by use of a transfer roller, for prevention of paper wrinkle, it is very effective to provide a material having more excellent mold releasability, lubricity than the surface characteristic of the transfer roller for the pressurizing roller surface. By provision of a PFA tube on the pressurizing roller surface as in the present embodiment, the above requirements can be satisfied to accomplish an image forming device free from pressurizing roller contamination and paper wrinkle.

Further, the characteristics demanded for the transfer roller, the pressurizing roller and the fixing device are specifically enumerated below.

For the relationship of the surface characteristics of the pressurizing roller and the transfer roller, more excellent lubricity is demanded for the pressurizing roller. For realization of this, the transfer roller may have a rubber layer on the surface, and the pressurizing roller a resin layer on the surface. This is because the surface characteristic of a rubber layer has generally a stronger force of attaching toner, paper powder, etc., as compared with a resin layer, being also greater in frictional force, whereby the recording material conveying force is stronger, and also no slippage will occur. Further, the above-mentioned effect is further increased by making the rubber layer of the outermost layer a polished surface.

For satisfying the characteristics as described above, a rubbery material such as EPDM, NBR, urethane, silicone, etc., particularly a soft rubbery material with a hardness of 40 degrees or less (JISA) may be employed as the transfer roller, and in this case, the rubber surface should be desirably a polished surface, but also a surface just demolded can sufficiently function. The above-mentioned rubber may be also foamed to be molded into a sponge and the surface polished to give sufficient characteristics.

On the other hand, the surface of the pressurizing roller should be desirably formed of a resin layer having lubricity, mold releasability, and is further demanded to have heat resistance. As the resin layer which can satisfy such demands, there can be employed fluorine resins such as of polytetrafluoroethylene, tetrafluoroethylene-perfluoroalkyl ether copolymers, tetrafluoroethylene-hexafluoropropylene copolymers, etc., silicone resins and others.

In the image forming device by use of the transfer roller, the pressurizing of the materials as described above, it is preferable that the pressurizing roller may have a hardness in the range of from 30 to 70 degrees in terms of ASKERC, and the total pressure between the fixing roller and the pressurizing roller be 15 kg or lower, whereby a slippage can be caused to occur effectively with ease.

By constituting the fixing device as described above, the fixing device can be made excellent in durability over a long term by merely applying a bias of the same polarity to that of the toner on the transfer roller without providing specially a cleaning means, etc. such as the transfer roller, whereby contamination of the pressurizing roller or generation of paper wrinkle can be also prevented. Further, the cleaning means, the mold release coating means, etc. can be also removed from the fixing device, whereby further simplification of the scanning device constitution can be simplified.

Figure 5:
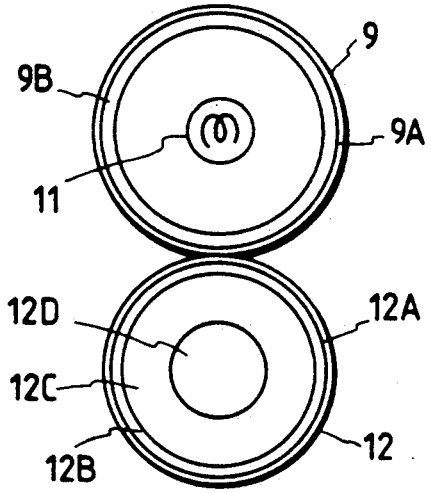
FIG. 5 is a schematic sectional view showing the fixing device of another embodiment of the present invention.

Next, another embodiment of the present invention is described by referring to FIG. 5.

The specific feature of the present embodiment resides in that a layer comprising a mixture of a rubber and a fluorine resin is used for the surface of the pressurizing roller. Since other conditions such as the transfer roller, etc. are the same as in the foregoing embodiment, and their descriptions are omitted.

FIG. 5 is a sectional view showing the fixing device in the present embodiment. In FIG. 5, the fixing roller 9 is made the same as in the embodiment described above, and the pressurizing roller 12 is a layer having an elastic layer 12C of a silicone rubber or a fluorine rubber provided around the core metal 12D, with its upper layers 12B and 12A being layers of calcined coating materials having a mixture of a fluorine resin and a fluorine rubber.

Thus, by coating a coating material having a mixture of a fluorine resin and a fluorine rubber, a fluorine resin layer 12A of a thin layer can be formed as the surface layer.

The mixture layer of the fluorine resin and the fluorine rubber is formed by, for example, coating an aqueous coating material of a fluorine rubber: Daiel Latex GL 213 (trade name, manufactured by Dakin Kogyo K. K.) by means of a spray gun, etc. to about 20 to 30 μm on the rubber layer 12C, and after drying, calcined at a temperature of 280° C. or higher. Within the mixture layer, the surface layer of the fluorine resin such as 12A is formed by floating out of the fluorine resin onto the surface through Brownian movement. The thickness of the surface layer 12A will vary depending on the calcination temperature and time, but when calcination is carried at 310° C. for about 30 minutes, the layer thickness becomes about 5 μm, and yet the fluorine resin content becomes very high, whereby the property concerning non-tackiness becomes excellent.

The PFA tube roller as described in the foregoing embodiment is ASKERC 52° in terms of the roller hardness, while in the present embodiment, the roller hardness of the roller of the same diameter is very soft as ASKER C 37°. Hence, the pressurizing force for obtaining the nip width sufficient for fixing may be smaller as compared with the PFA tube roller, whereby there is the advantage that the latitude of wrinkle of paper, envelope, etc. can be broadened. Also, since a satisfactory nip can be formed under a low pressure, it becomes possible to make the image forming device higher in speed. Further, advantageous results are obtained with respect to abrasion of the pressurizing roller surface layer by friction with paper or fixing roller.

After coating of the mixture layer of the fluorine resin and the fluorine rubber with a thickness of 30 μm on a silicone rubber with a rubber hardness of JISA 15° and 5 (mm) thickness as the elastic rubber layer 12C, the pressurizing roller with a roller diameter of 20 mm heated at 310° C. for 30 minutes was used for the fixing device of the image forming device by use of a transfer roller having no mold release coating mechanism and cleaning mechanism to carry out the durability test. As the result, after up to 200,000 sheets of paper passage, no irregularity was formed in the grey image and there was also no generation of paper wrinkle, etc.

According to the present embodiment, by providing a mixture layer of a fluorine resin and a fluorine rubber on the pressurizing roller surface, a non-tacky pressurizing roller with low roller hardness can be obtained, whereby it becomes sufficiently possible to correspond to speed-up of the image forming device. In the present embodiment, it is also possible to control the resistance value of the pressurizing roller by further mixing an electroconductive substance into a mixture of a fluorine rubber and a fluorine resin.

Figure 6:
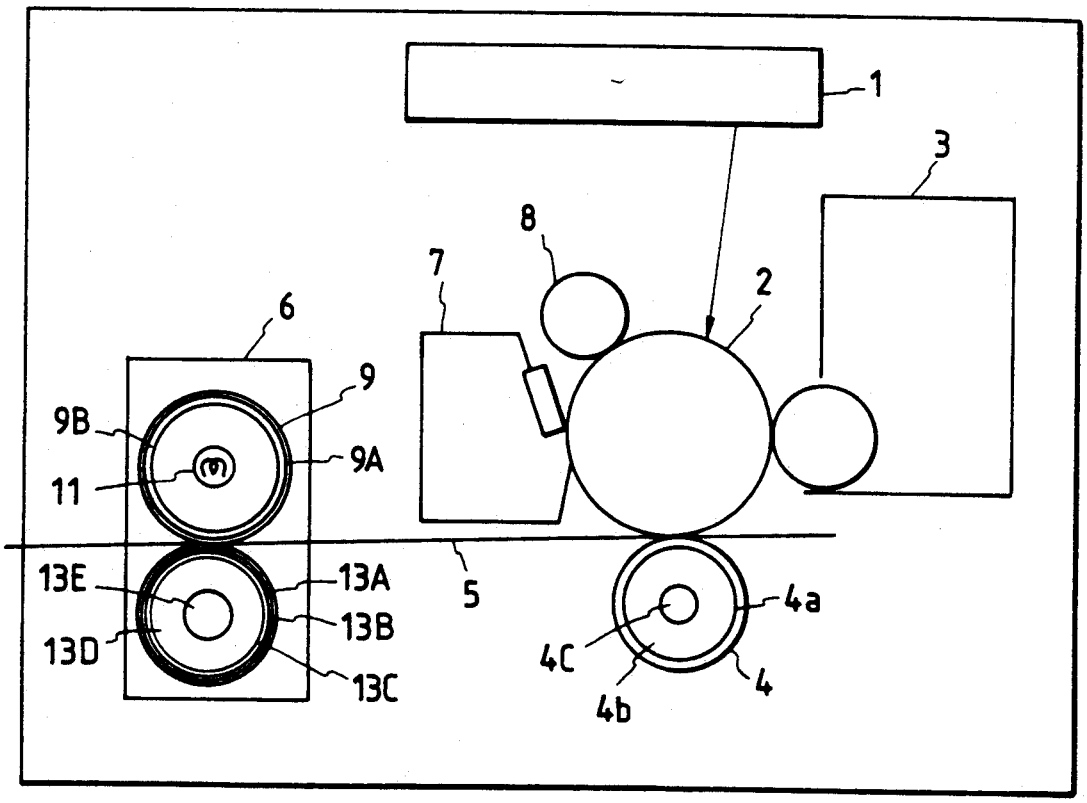
FIG. 6 is a schematic sectional view showing still another embodiment of the present invention.

FIG. 6 is a schematic sectional view of the image forming device which is another embodiment of the present invention. The specific feature of the present embodiment corresponds to higher speed-up, higher durability of the printer by improvement of the transfer roller 4 and the fixing device 6. Other image forming portions of the present invention are the same as in the embodiment of FIG. 3 as described above, and their descriptions are omitted.

The transfer roller 4 was formed by providing an electroconductive foamed urethane sponge with a resistance value of $10^5\Omega$ with a thickness of 5 mm on a core metal made of iron or SUS with an outer diameter of 6 mm, and providing a urethane rubber having a volume resistivity value of $10^{10}$ Ωm with a thickness of 1 mm thereon to obtain a transfer roller with an outer diameter of 20 mm. The transfer roller at this time had a roller hardness of 35 degrees in terms of ASKERC and a resistance value of $10^9\Omega$.

By employing such constitution, in spite of low roller hardness, because of having a urethan rubber having the specific features of excellent abrasion resistance as well as high frictional coefficient and high strength as the surface layer, there is no abrasion, flaw, etc. by successive use, to give a transfer roller having excellent conveying performance.

Generally speaking, soft rubber or foamed sponge has no abrasion resistance, and when used over a long term, the outer diameter becomes smaller and, when a transfer roller is driven, the circumferential speed becomes slower to lower the conveying force or generate flaws, whereby tone is embedded there to make cleaning impossible. For this reason, the durability life of the transfer roller was about 100,000 sheets, but the present embodiment has a durability performance of 300,000 sheets or more.

On the other hand, the specific feature of the fixing device resides in that the pressurizing roller life was extended by providing further a layer only of a fluorine resin on the surface layer of the pressurizing roller described in the embodiment in FIG. 5.

In FIG. 6, around the core metal 13E, a silicone rubber or fluorine rubber layer 13D was provided and a mixture comprising a fluorine rubber and a fluorine resin was coated to about 20 to 30 μm (13C, 13B layers), followed by drying. On the coating was coated a FEP or PFA resin under emulsion state to about 10 μm (layer 13A), followed by primary calcination. At this time, the mixture layer of the fluorine resin and the fluorine rubber floats up to the side of the layer 13A through Brownian movement of the fluorine resin, whereby separation occurs into the layer 13B rich in the fluorine resin and the layer 13C rich in the fluorine rubber. The layer 13B is well compatible with the fluorine resin 13A and therefore adhesion strength is increased. Then, calcination is carried out again at a higher temperature than in the primary calcination to melt the fluorine resin on the surface layer, thereby effecting complete adhesion and making the surface smoother.

In the present embodiment, since the thickness of the fluorine resin layer becomes 10 μm or more, durability to contamination of the pressurizing roller will be improved as compared with the embodiment described in FIG. 5. Besides, as for the roller hardness, it is elevated by only about 3° in terms of ASKERC as compared with the pressurizing roller, and a nip can be formed under a low pressure, whereby sufficient fixability can be obtained even if the printer speed is accelerated. There is also sufficient effect for preventing the generation of wrinkles of paper, envelopes.

According to the experiments by the present inventors, as the result of evaluation of a pressurizing roller by successive printing tests on printing of 300,000 sheets, which pressurizing roller was obtained by coating a roller, having a diameter of 20 mm and made of a silicone rubber with a rubber hardness of JISA 20° and a thickness of 5 (mm), with a mixture layer of a fluorine resin and a fluorine rubber to a thickness of 30 μm and further with an FEP emulsion to 10 μm, followed by primary calcination at 260° C. for 15 minutes and secondary calcination at 310° C. for 30 minutes, there was slight contamination attached onto the peeled surface layer corresponding, but it was not so excessive as to disturb the image, and there was no change in performances of the transfer roller 4. Hence, as compared with the embodiment shown in FIG. 5, the life was further elongated to give a printer with longer life and higher speed.

To give concrete numerical values, the transfer roller and the fixing device can be used without exchange up to 300,000 sheets, whereby there can be provided an image forming device capable of giving fixability sufficiently corresponding to higher speed-up to about 120 mm/sec. in terms of paper delivery speed.

Next, still another embodiment of the present invention is to be described.

This embodiment is intended to lower the hardness of the pressurizing roller as described above in order to improve fixability and prevent the recording material from generation of wrinkles, etc.

In the following, the specific constitution of the pressurizing roller is described by referring to FIG. 7. The pressurizing roller 18 has an elastic material layer 18B around a shaft-shaped core metal 18C and further a fluorine resin layer 18A coated thereon. For the elastic material layer 18B, a foamed HTV or LTV silicone rubber is used, and yet in said elastic material layer 18B exists a plurality of holes extending through the lengthy direction of the roller shaft. As the surface layer, a tetrafluoroethylene-perfluoroalkyl vinyl ether copolymer (PFA) tube 18A is coated.

A specific feature of the pressurizing roller is that hardness can be controlled more easily at lower hardness as compared with, for example, when employing a silicone rubber solid, because a foamed material is used for the elastic material layer.

Next, the method for preparing the elastic material as described above is described.

Figure 8:
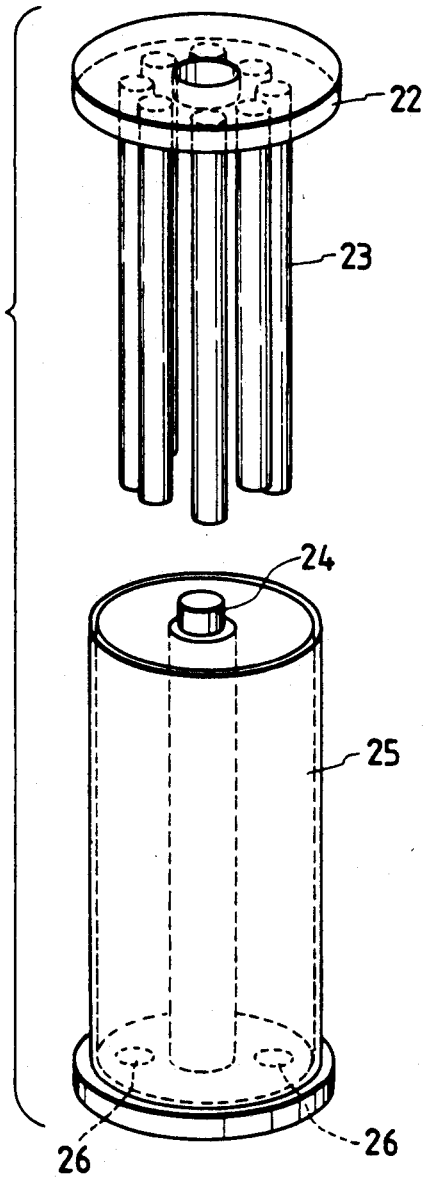
FIG. 8 is a schematic sectional illustration for explanation of the preparation method of the pressurizing roller in FIG. 7.

FIG. 8 outlines the mold when molding the elastic material of the present embodiment. At the center of the mold 25, a pressurizing roller core metal 24 already applied with primer coating is mounted, and here a lid 22 is to be assembled.

The lid 22 has a core material 23 for providing thru-holes mounted. After mounting of the lid, a rubbery material containing a foaming agent is injected through a rubbery material inlet 26, foamed and vulcanized to be molded.

Here, the effect of the pressurizing roller by use of the above-mentioned silicone rubber foam was ascertained by the experiment. For experiment, the image forming device shown in FIG. 3 was used, and the transfer roller capable of turning over the polarity of bias as described above was used. For the pressurizing roller, as contrasted to the pressurizing roller as shown in FIG. 7, a pressurizing roller having a silicone rubber layer having no thru-hole was employed as control.

The pressurizing roller has the following specifications.

(i) First pressurizing roller

A foamed HTV silicone rubber was used with a thickness of 5 mm for the elastic layer of the pressurizing roller. The foam is provided with 18 thru-holes with a diameter of 1 mm in the axial direction (dispersed uniformly within the circle). The surface was coated with 50 μm of PFA tube. The roller has an outer diameter of 20 mm and a roller hardness of 42° (ASKER C).

(ii) Second pressurizing roller

For the elastic material layer, an LTV silicone rubber (JIS A 20°) was used with a thickness of 5 mm. The surface layer was coated with 50 μm of PFA tube. The roller had an outer diameter of 20 mm and a hardness of 55° (ASKER C).

The two kinds of pressurizing rollers as mentioned above were evaluated by the image forming device shown in FIG. 3. For the fixing roller at this time, one having the structure of the embodiment as described above and an outer diameter of 25 mm was employed.

Under the conditions as mentioned above, the pressurizing force of the fixing roller and the pressurizing roller were gradually increased, and the maximum pressurizing force when no wrinkle was generated was examined. As the result, in the above-mentioned second pressurizing roller, 0.28 kgf/cm was the maximum as the line pressure at the nip, while in the above-mentioned first pressurizing roller, 0.35 kgf/cm was the maximum. In other words, it has been found that the first pressurizing roller according to the present embodiment has a relatively lower hardness even the surface layer was coated with the PFA tube and no wrinkle is formed even when the pressurizing force is made higher. Thus, if the pressurizing force can be made higher, fixability will be improved.

When the two pressurizing rollers as mentioned above were set at the above maximum pressurizing forces, respectively, for comparison of fixability of gray images, fixability was elevated by 5 to 8% when the first pressurizing roller was employed. Fixability as herein mentioned is represented by the density lowering ratio when the grey image fixed on the recording was rubbed with "Silbon C (trade name)" under the state pressed at a pressure of 0.4 g/mm$^2$ for 5 times, and can be determined according to the following formula:

$$\text{Fixability (\%)} = \{(\text{Density before rubbing} - \text{density after rubbing})/\text{density before density}\} \times 100.$$

As described above, the elastic material layer is provided with thru-holes, where by thermal expansion of the foam with heat receiving during fixing actuation can be absorbed to inhibit the change in roller diameter. However, for preventing thermal expansion of the bubbles within the elastic material layer, the thru-holes as mentioned above are required, but only holes, provided that they are continuous, can release the expanded air within the bubbles to obtain sufficient effect.

Specifically, by dispersing uniformly crystal grains of NaCl in the silicone rubber containing the foaming agent, followed by foaming and vulcanization, and then dissolving out NaCl within the foam elastic material to form voids. Due to those voids extremely approximate to each other, they can effectively function as continuous holes.

The phenomenon of diameter change due to thermal expansion does not only change the nip, thereby changing the fixing conditions, but when the surface is applied with PFA tube coating, when expansion, shrinkage are repeated, PFA tube is caused to generate wrinkles or generate peel off from the elastic material layer.

However, by use of the pressurizing roller of the present embodiment, no trouble due to thermal expansion will be caused to occur even with a roller having a fluorine resin layer on the surface, but only advantages inherently possessed by sponge roller can be effectively utilized.

As can be understood from the two experiments as described above, according to the present embodiment, since the pressurizing roller has holes through the elastic material layer, and therefore the pressurizing roller can be made to have lower hardness, no wrinkle will be generated even when the pressurizing force is made greater to give good fixability. The pressure roller has a fluorine resin layer as the surface layer and therefore it exhibits more excellent lubricity than the surface layer of the transfer roller, whereby the stress of paper can be released to eliminate wrinkles. Moreover, since the fluorine resin surface layer of the pressurizing roller exhibits more excellent mold releasability than the transfer roller surface layer, there is no contamination of the pressurizing roller surface, either.

Next, still another embodiment of the present invention is described.

This embodiment exhibits a specific embodiment in which the pressurizing roller is subjected to electroconductive treatment for prevention of off-set of the toner.

Figure 7:
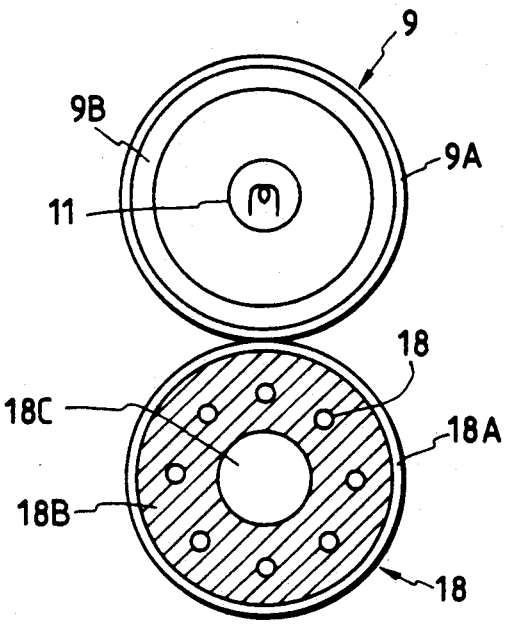
FIG. 7 is a schematic sectional view showing still another embodiment of the present invention.

In the embodiment shown in FIG. 7, the material of the silicone rubber foam which is the elastic material layer of the pressurizing roller has generally a high volume resistivity of $10^{14}$ Ω·cm, and yet is also coated on the surface layer with an insulating PFA tube. Hence, when the fixing actuation is repeatedly performed with the constitution as shown in FIG. 3, if the pressurizing roller is charged to minus through friction with the recording material or the fixing roller, because of absence of the field for escape of the charges, it will be gradually charged up, until its surface potential will exhibit a very high potential on the minus side as −3 kV to −5 kV. At this time, for example, in an image forming device by use of a toner charged to minus, at the pressurizing roller, a force will act which repels the toner from the recording material toward the fixing roller side, whereby the phenomenon of the so called off-set is liable to be caused to occur. For solving this problem, charge-up of the pressurizing roller is intended to be prevented by making the pressurizing roller side electroconductive.

Figure 9:
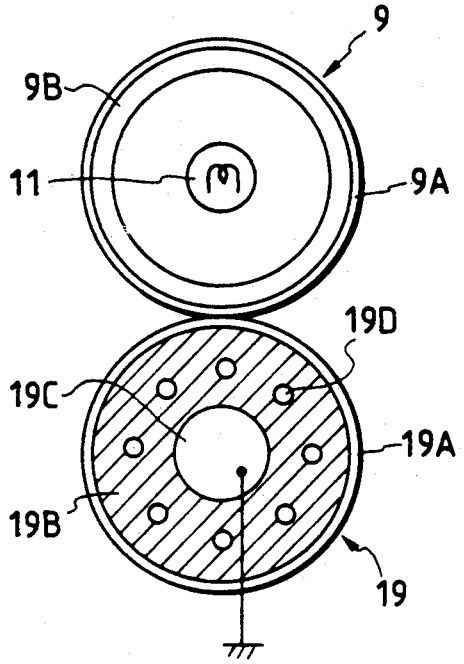
FIG. 9, FIG. 10, FIG. 11 and FIG. 12 are schematic sectional views showing the embodiments of the fixing devices applied with off-set prevention measures of toner of the present invention.

In FIG. 9, the fixing roller 9 is made to have the same structure as in the embodiment described above. On the other hand, as to the pressurizing roller 19, an electroconductive elastic material layer 19B is provided around the earthed core metal 19C, and further an electroconductive fluorine resin layer 19A is covered thereon. With these constitutions, the charges are permitted to escape to prevent the pressurizing roller from being charged up.

To describe about the pressurizing roller in more detail, the elastic material layer 19B has a plurality of holes 19D extending through the foam of the same silicone rubber as described in the embodiment in FIG. 7 over the roller axis direction. However, for the silicone rubber, for example, one which is made lower in resistance by dispersion of carbon to its volume resistivity of $10^{11}$ Ω·cm or lower. As for the fluorine resin layer 19A of the surface layer, it is also subjected to electroconductive treatment, and for example, there is employed one which is made to have a volume resistivity of $10^{12}$ Ω·cm or less with PFA tube made lower in resistance by dispersion of carbon.

When carbon, etc. is dispersed for making the silicone rubber lower in resistance, rubber hardness generally tends to be increased, and this tendency becomes more marked as one seeks to further lower resistance. More specifically, if the volume resistivity is made about $10^5$ Ω·cm, the rubber hardness will be increased by about 7° (JIS A) as compared with the original insulating state. Such excessive hardness increase has been practically handleable with difficulty from the aspects of fixability, prevention of wrinkle of the recording material.

However, if the structure is that of the pressurizing roller as described in the present embodiment, the roller hardness depends rather on the foaming conditions than the hardness of its own, and therefore it becomes possible to lower the resistance without substantially accompanying increase in roller hardness.

Next, the experiment conducted on the basis of the device of the present invention is described. In the image forming device shown in FIG. 3, when using the fixing device in FIG. 9, for the pressurizing roller, the electroconductive silicone rubber with a volume resistivity of about $10^5$ Ω·cm was employed for the foam, while for the electroconductive fluorine resin layer of the surface layer, one with a volume resistivity of about $10^{11}$ Ω·cm and a thickness of 50 μm was employed. The thickness of the elastic material layer was made 5.0 mm, and the pressurizing roller outer diameter 20 mm. In this case, the roller hardness was 45° (ASKER C).

When the pressurizing roller surface potential during fixing actuation was measured by use of the pressurizing roller comprising the constitution as mentioned above, it was found to be substantially 0V to confirm that charge-up was cancelled. Also, no off-set appeared by evaluation under the environment of 20° C., 60%.

As described above, according to the present embodiment, by making the pressurizing roller lower in resistance, in addition to the same effects as in the embodiment in FIG. 7, charge-up of the pressurizing roller can be prevented to prevent off-set of the toner.

Figure 10:
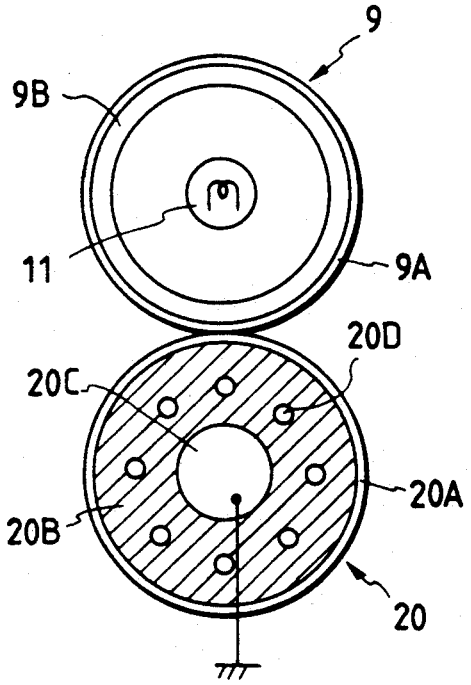

Next, the embodiment in FIG. 10 is different from that in FIG. 9 in that the surface layer of the pressurizing roller is made an insulating fluorine resin tube.

As described above, as a problem when the pressurizing roller is made lower in resistance, if the recording material absorbs moisture under high temperature and high humidity conditions, transfer current flows out through the pressurizing roller from the recording material, whereby there is the possibility to cause defective transfer to occur. Hence, in the present embodiment, it is intended to prevent flow-out of the transfer current by making the pressurizing roller surface layer an insulating tube.

In FIG. 10, the fixing roller side is made the same as in the embodiment in FIG. 7. As for the pressurizing roller 20, it has the constitution having an elastic material layer 20B which is an electroconductive foam and has a plurality of holes 13D extending therethrough with respect to its roller axis direction provided around the earthed core metal 20C and an insulating fluorine resin layer 20A on its surface layer. Here, the elastic material 20B is made the same as one described in the embodiment in FIG. 9, and the fluorine layer on the surface made the same as described in the embodiment in FIG. 7.

In the pressurizing roller in the present embodiment, the charges obtained through friction between the fixing roller and the recording material cannot be escaped directly. However, the electrostatic capacity between the core metal and the pressurizing roller surface is greater by about one order as compared with the insulating elastic material layer as described in the embodiment in FIG. 7. Therefore, even if the same amount of charges may be received, the potential elevation of the pressurizing roller is very small, and as a practical problem, in view of escape of charges into the air, it may be regarded that there is substantially no potential elevation of the pressurizing roller.

Next, the experiment conducted on the basis of the present embodiment is described. The fixing device is made to have the structure shown in FIG. 10, and the experiment was conducted by the image forming device with the structure shown in FIG. 3. As for the pressurizing roller 20, an electroconductive to be used for the foam may be one having a volume resistivity of about $10^5$ Ω·cm, and the fluorine resin layer of the surface layer was coated with PFA tube with a thickness of 50 μm. The thickness of the elastic layer was made 5.0 mm, and the pressurizing roller outer diameter 20 mm.

When the surface potential of the pressurizing roller when performing practically paper passage of the recording material was measured, it was found to be about −100V with no higher change being observed. From this fact, it can be understood that there is sufficient effect in charge-up of the pressure roller by having the above-described constitution. At this time, in evaluation under normal temperature and normal humidity (20° C., 60%), no off-set image was generated.

Figure 11:
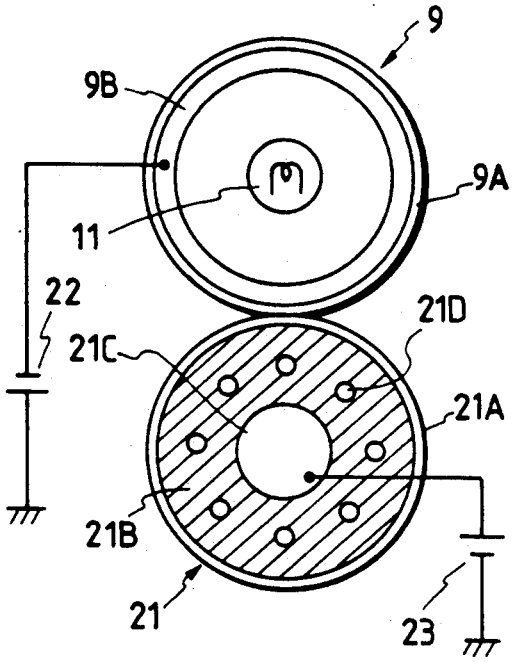

Next, the embodiment in FIG. 11 is different from the previous embodiment in applying a bias on the fixing roller and the pressurizing roller.

Concerning off-set, to pay attention on the relationship with the surface potential of the roller, in the case of the image forming device by use of a toner charged to minus, by making the fixing roller side minus potential and the pressurizing roller side plus potential, an electrical field is formed in the direction of pressing the toner against the recording material, and therefore it is effected for off-set prevention.

Hence, in the present embodiment, in the fixing device as described in the embodiment in FIG. 10, by applying a bias on the fixing roller and the pressurizing roller, off-set prevention can be made surer.

In FIG. 11, the fixing roller 9 has a fluorine resin layer 9A on the surface of the core metal 9B, and a minus bias application is performed by a sliding electrode (not shown) by use of a DC power source 22 as its core metal 9B. On the other hand, the pressurizing roller 21 has a foam which comprises an electroconductive silicone rubber and has a plurality of holes 21D extending therethrough in the roller axis direction as the elastic layer 21B, and has PFA tube 21A as the insulating fluorine resin layer on its surface layer provided around the core metal 21C, and a plus bias is applied through a sliding electrode (not shown) from the DC power source 23.

In the case of the present embodiment, because the elastic material layer of the pressurizing roller has low resistance, when a bias is applied, sufficient potential difference can be created between the pressurizing roller surface and the elastic material layer 21B, and therefore an electrical field for attracting the negatively charged toner toward the pressurizing roller side can be effectively obtained.

When the off-set prevention effect by external bias was confirmed by the image forming device shown in FIG. 3, if there is a potential difference of about 1 kV between the fixing roller core metal and the pressurizing roller core metal (specifically, −500 V on the fixing roller side, +500 V on the pressurizing roller side), no off-set phenomenon emerged even under severe conditions under low humidity environment (10%).

Figure 12:
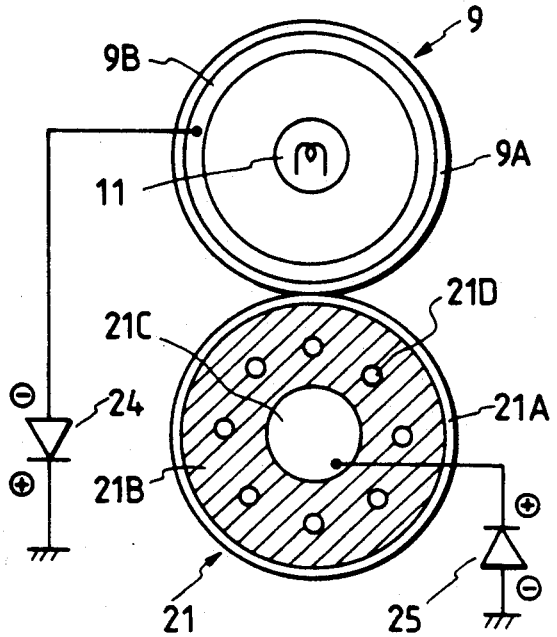

Next, the embodiment in FIG. 12 is different from the embodiment in FIG. 11 in that an electrical field in a desired direction is formed between the fixing roller and the pressurizing roller by use of a diode without use of external bias.

In FIG. 12, the fixing roller and the pressurizing roller were made the same as those described in the embodiment in FIG. 11, and to the fixing roller metal core 9B was connected the diode 24 so that the fixing roller was on the minus side, while to the pressurizing roller metal core 21 was connected the diode 25 so that the pressurizing roller was on the positive side.

As for the function of the diode used here, it is influenced by mutual frictions between the fixing roller, the pressurizing roller, the recording material, the toner, etc. and the charges possessed by the respective members, and the charges will move between the respective core metals of the fixing roller and the pressurizing roller. In that case, due the presence of the diode between the ground, negative charges are selectively accumulated, and also positive charges selectively accumulated on the pressurizing roller side, whereby the fixing roller side is shifted to the negative potential and the pressurizing roller side to the positive potential.

Next, the experiment conducted on the basis of the present embodiment is described. In the fixing roller 9, a fluorine resin layer 30 μm is provided on the core metal 9B. The pressurizing roller 21 has on the core metal 21C an elastic material layer 21B with a thickness 5.0 mm having a plurality of holes 13D extending therethrough in the roller axis direction obtained by foaming of an HTV silicone rubber with a volume resistivity of about $10^5$ Ω·cm, and an insulating PFA tube 21A of 50 μm coated on the surface layer with the roller diameter being made 20 mm. For the diodes connected electrically to the respective core metals, in view of the charges given to the respective rollers, those with about 2 kV as the reverse dielectric strength and electrostatic capacities of some pF levels were employed.

In the constitution as described above, paper passage of the recording material with the constitution shown in FIG. 3, whereby the fixing roller surface potential became about −700 V, the surface potential of the pressurizing roller about +400 V, and the potential difference from the upper and lower rollers about 1.1 kV. Practically for the off-set image, it did not appear also under low humidity environment (10%).

Thus, according to the embodiment in FIG. 12, in the fixing device by use of an elastic material layer of the pressurizing roller which has been made lower in resistance, by connecting the diodes to the respective core metals of the fixing roller and the pressurizing roller, a desired electrical field can be generated between the fixing roller and the pressurizing roller to prevent the off-set phenomenon.

In the above-described embodiments, description has been made about the negatively charged toner, but the above-mentioned bias voltage, diode, etc. may be set to the opposite polarity in the case of an image forming device by use of a positively charged toner.

Application of the above-mentioned bias or the diode may not be connected to the both rollers, but may also be done to only the pressurizing roller side or the fixing roller side.

Whereas, in the embodiments of the respective fixing devices of transfer devices as described above, description has been made as the rotary members, but they can be also applied to belt shapes, etc.

As the fixing device of the present embodiment, one having a pair of rotatory members has been shown, but the present invention is not limited thereto, but it is also of course applicable to the fixing device as described in U.S. Ser. No. 444,802.

As described above, according to the present invention, stable conveyability can be obtained without causing such problems as image irregularity, winding of the recording material around the pressurizing roller, etc., and also preventing paper wrinkle for various recording materials from thin paper to envelope, and therefore correspondence to higher speed-up of the image forming device is sufficiently possible.

What is claimed is:

1. An image forming device comprising:

a movable image bearing member;

transfer means for transferring the image on said image bearing member, said transfer means having a moving member moving a recording material while pressing it against said image bearing member; and fixing means for fixing the image onto the recording material, said fixing means having a pair of moving members for fixing an unfixed image by conveying the recording material sandwiched therebetween, wherein a distance between a position where the moving member of said transfer means presses the recording material against said image bearing member and a position where said pair of moving members abut each other is shorter than a length of the recording material with the maximum size to be used, and wherein at least one of said paired moving members for fixing has a rubber layer and a surface resin layer, frictional coefficient of said surface resin layer being smaller than that of the surface of the moving member of said transfer means.

2. An image forming device according to claim 1, wherein said surface resin layer is a fluorine resin layer.

3. An image forming device according to claim 1, wherein said elastic material layer is a rubbery layer.

4. An image forming device according to claim 2, wherein said elastic material layer is a rubbery layer.

5. An image forming device according to claim 1, wherein said rubber layer is a silicone rubber layer.

6. An image forming device according to claim 4, wherein said rubbery layer is a silicone rubber layer.

7. An image forming device according to claim 2, wherein said fluorine resin layer is a surface layer obtained by coating a mixture of a fluorine resin and a fluorine rubber on said rubber layer followed by calcination.

8. An image forming device according to claim 1, wherein said surface resin layer is a fluorine resin tube layer.

9. An image forming device according to claim 2, wherein said fluorine resin layer is a surface layer obtained by coating a fluorine resin on the layer, which is obtained by coating a mixture of a fluorine resin and a fluorine rubber on said rubber layer followed by calcination.

10. An image forming device according to claim 5, wherein said rubber layer is a foamed material layer.

11. An image forming device according to claim 6, wherein said rubbery layer is a foamed material layer.

12. An image forming device according to claim 10, wherein said resin surface layer is a fluorine resin tube layer.

13. An image forming device according to claim 11, wherein said resin surface layer is a fluorine resin tube layer.

14. An image forming device according to claim 1, wherein said rubber layer is subjected to electroconductive treatment.

15. An image forming device according to claim 14, wherein said rubber layer has a volume resistivity value of $10^{11}$ Ω·cm or less.

16. An image forming device according to claim 14, wherein said surface resin layer is subjected to electroconductive treatment.

17. An image forming device according to claim 16, wherein said resin surface layer has a volume resistivity value below $10^{12}$ Ω·cm.

18. An image forming device according to claim 14, wherein said rubber is a silicone rubber layer.

19. An image forming device according to claim 18, wherein said surface resin layer is a fluorine resin layer.

20. An image forming device according to claim 19, wherein said rubber layer is a foamed material layer.

21. An image forming device according to claim 16, wherein said surface resin layer is a fluorine resin layer.

22. An image forming device according to claim 4, wherein the moving member on the side not in contact with said unfixed image has a core material earthed beneath said rubber layer.

23. An image forming device according to claim 16, wherein the moving member on the side not in contact with said unfixed image has a core material earthed beneath said rubber layer.

24. An image forming device according to claim 2, wherein the moving member on the side in contact with the unfixed image of said pair of moving members has a fluorine surface resin layer.

25. An image forming device according to claim 1, wherein the moving member on the side not in contact with said unfixed image is a rotary member.

26. An image forming device according to claim 25, wherein said fixing means is a heating fixing means.

27. An image forming device according to claim 1, wherein the moving member of said transfer means is a rotary member having elasticity.

28. An image forming device according to claim 27, wherein said rotary means has a foamed sponge rubber layer on the core material, and the formed sponge rubber layer constitutes the surface layer.

29. An image forming device according to claim 27, wherein said moving member of said transfer means is applied with a predetermined voltage.

30. An image forming device according to claim 28, wherein said moving member is applied with a predetermined voltage.

31. An image forming device according to claim 29, wherein said moving member is applied with a voltage of the opposite polarity during non-transfer to that during transfer.

32. An image forming device according to claim 30, wherein said moving member is applied with a voltage of the opposite polarity during non-transfer to that during transfer.

33. An image forming device according to claim 27, wherein said rotary member has a foamed sponge rubber layer on the core material, and has a surface rubber layer thereon.

34. An image forming device according to claim 1, wherein the lubricity of the surface of the moving members of said fixing means is better than that of the surface of the moving member of said transfer means.

35. An image forming device according to claim 14, wherein a bias is applied on one of the pair of moving members of said fixing means.

36. An image forming device according to claim 14, wherein a diode is connected in a predetermined direction to one of the pair of moving members of said fixing means.

37. An image forming device according to claim 1, wherein one of paired moving members not contacting with the unfixed image has said rubber layer and said surface resin layer.

38. An image forming device according to claim 1, wherein said moving member of transfer means has a surface layer made of sponge rubber.

39. An image forming apparatus according to claim 38, wherein said sponge rubber is a urethane rubber.

* * * * *

UNITED STATES PATENT AND TRADEMARK OFFICE

CERTIFICATE OF CORRECTION

PATENT NO. : 5,264,902
DATED : November 23, 1993
INVENTOR(S) : Koichi Suwa, et al It is certified that error appears in the above-indentified patent and that said Letters Patent is hereby corrected as shown below:

On the title page item [30]

"Jun. 29, 1992 [JP] Japan.....2-169823" should read --Jun. 29, 1990 [JP] Japan.....2-169823--.

COLUMN 1
Line 25, "device 3" should read --device 3,--;
Line 59, "fault" should read --faulty--.

COLUMN 2
Line 51, "fault" should read --faulty--.

COLUMN 5
Line 15, "for" should be deleted.

COLUMN 6
Line 68, "and" should be deleted.

COLUMN 8
Line 18, "urethan" should read --urethane--;
Line 29, "tone" should read --toner--.

--

UNITED STATES PATENT AND TRADEMARK OFFICE

CERTIFICATE OF CORRECTION

PATENT NO. : 5,264,902

DATED : November 23, 1993

INVENTOR(S) : Koichi Suwa, et al

It is certified that error appears in the above-indentified patent and that said Letters Patent is hereby corrected as shown below:

COLUMN 10

Line 49, "density before density " should read --density before rubbing --;

Line 51, "where by" should read --whereby--.

COLUMN 11

Line 61, "about" should be deleted.

COLUMN 14

Line 30, "due" should read --due to--.

COLUMN 15

Line 21, "wrinkle" should read --wrinkles--.

COLUMN 16

Line 25, "resin surface" should read --surface resin--;

Line 28, "said rubber" should read --said rubber layer--;

Line 35, "claim 4," should read --claim 14,--;

Line 57, "formed" should read --foamed--.

COLUMN 18

Line 15, "apparatus" should read --device--.

Signed and Sealed this

Twenty-ninth Day of November, 1994

Bruce Lehman

*Attest:*

BRUCE LEHMAN

*Attesting Officer*

*Commissioner of Patents and Trademarks*